US010641488B2

(12) United States Patent
Haussner et al.

(10) Patent No.: US 10,641,488 B2
(45) Date of Patent: May 5, 2020

(54) GLOW PLUG

(71) Applicant: BorgWarner Ludwigsburg GmbH, Ludwigsburg (DE)

(72) Inventors: Michael Haussner, Benningen (DE); Ralf Ehlert, Stuttgart (DE)

(73) Assignee: BorgWarner Ludwigsburg GmbH, Ludwigsburg (DE)

( * ) Notice: Subject to any disclaimer, the term of this patent is extended or adjusted under 35 U.S.C. 154(b) by 387 days.

(21) Appl. No.: 15/792,399

(22) Filed: Oct. 24, 2017

(65) Prior Publication Data

US 2018/0119956 A1 May 3, 2018

(30) Foreign Application Priority Data

Oct. 27, 2016 (DE) ..... 10 2016 120 578
Nov. 8, 2016 (DE) ..... 10 2016 121 346

(51) Int. Cl.
*F23Q 7/22* (2006.01)
*F23Q 7/00* (2006.01)

(52) U.S. Cl.
CPC ..... *F23Q 7/22* (2013.01); *F23Q 7/001* (2013.01); *F23Q 2007/005* (2013.01); *H05B 2203/027* (2013.01)

(58) Field of Classification Search
USPC ..... 219/267
See application file for complete search history.

(56) References Cited

U.S. PATENT DOCUMENTS 6,653,601 B2 11/2003 Taniguchi et al.
2010/0078421 A1* 4/2010 Burrows ..... F23Q 7/22 219/270
2011/0215080 A1 9/2011 Hain et al.
2015/0135521 A1* 5/2015 Kasimirski ..... F23Q 7/001 29/611

FOREIGN PATENT DOCUMENTS

DE 102009056057 A1 6/2010
DE 102014220036 A1 * 4/2016 ..... F23Q 7/001
WO WO 2014064279 A1 5/2014
WO WO 2015014844 A1 2/2015

* cited by examiner

*Primary Examiner* — Joseph M Pelham
(74) *Attorney, Agent, or Firm* — Bose McKinney & Evans LLP

(57) ABSTRACT

Described is a glow plug having a casing and a ceramic glow pin protruding out of the casing. The glow pin has a tapered end section inside the casing. A metal protective tube protrudes out of the casing and surrounds the glow pin. The protective tube has a widened end section inside the casing. A center electrode is arranged in the casing and electrically connected to the glow pin. The glow plug includes an annular or sleeve-shaped contact element through which the glow pin projects and to which the tapered end section of the glow pin is soldered. The contact element is at least partly surrounded by the widened end section of the protective tube.

12 Claims, 3 Drawing Sheets

GLOW PLUG

RELATED APPLICATIONS

This application claims priority to DE 10 2016 120 578.8, filed Oct. 27, 2016, and also claims priority to DE 10 2016 121 346.2, filed Nov. 8, 2016, both of which are hereby incorporated herein by reference in their entireties.

BACKGROUND

This disclosure is based on a glow plug comprising a casing, a ceramic glow pin protruding out of the casing and having a tapered end section inside the casing, a protective tube which is made of metal and protrudes out of the casing and surrounds the glow pin, a center electrode, which is arranged in the casing and electrically connected to the glow pin, and an annular or sleeve-shaped contact element, through which the glow pin projects and to which the tapered end section of the glow pin is soldered. Such a glow plug is known from U.S. Publication No. 2011/0215080 A1.

Ceramic glow pins are susceptible to fractures and are therefore protected by a protective tube which is made of metal and projects out of the casing of the glow plug. The ceramic glow pin sits in the protective tube and projects with its combustion chamber side end, i.e., the glow tip, out of the protective tube. In the casing, the glow pin is electrically connected to a center electrode via a tapered end section. This tapered end section is surrounded by an annular or sleeve-shaped contact element which on its inside is shaped to fit the tapered end section, and soldered to the same. Generally, the glow pin is thus connected via the center electrode to potential and via the contact element to earth.

SUMMARY

This disclosure shows how the fracture risk of the ceramic glow pin of such a glow plug can be further reduced or in the case of a fracture the risk that fragments fall into the combustion chamber of the engine can be reduced.

In a glow plug according to this disclosure, an end section of the protective tube is widened, i.e., its inner diameter and its outer diameter are increased, for example by plastic deformation. The contact element can therefore be arranged at least partially in the protective tube and the tapered end section of the ceramic glow pin that is particularly susceptible to breakage better protected. By widening the protective tube its wall thickness, compared with enlargement drilling, is substantially retained so that the mechanical stability and consequently the protective function is preserved even in the expanded end section.

An advantageous refinement of this disclosure provides that the glow plug is a pressure measuring glow plug, i.e., the glow pin is moveable in its longitudinal direction relative to the casing and the pressure acting on the glow pin is detected with a pressure sensor. With such a pressure measuring glow plug the protective tube presses on the pressure sensor via a transmission element. Since by way of widening the protective tube the mechanical stability, in particular the radial stability, of the protective tube is not negatively affected, interference signals during the transmission of the pressure acting on the glow pin are avoided.

Preferably, the expanded end section of the protective tube and the transmission element are inserted into one another, for example in that the protective tube is inserted into the transmission element. The end section of the protective tube and the transmission element can be welded to one another.

In order to obtain the advantages according to this disclosure, a small widening of the protective tube, namely an increase in diameter that is large enough to allow the contact element to project into the protective tube and even be entirely arranged inside the protective tube is sufficient. Preferably, the end section of the protective tube is widened by not more than twice the wall thickness of the protective tube, i.e., the inner diameter is not increased by more than double the wall thickness. For example, the expansion can amount to between half of the wall thickness and the wall thickness.

A further advantageous refinement of this disclosure provides that the widened end section of the protective tube has an inner diameter which is smaller than the outer diameter of a cylindrical main section of the protective tube. Between the expanded end section and the cylindrical main section a transition section can be present which is shorter than the end section. The transition section can for example be conically shaped.

BRIEF DESCRIPTION OF THE DRAWINGS

The above-mentioned aspects of exemplary embodiments will become more apparent and will be better understood by reference to the following description of the embodiments taken in conjunction with the accompanying drawings, wherein.

DESCRIPTION

The embodiments described below are not intended to be exhaustive or to limit the invention to the precise forms disclosed in the following detailed description. Rather, the embodiments are chosen and described so that others skilled in the art may appreciate and understand the principles and practices of this disclosure.

Figure 1:
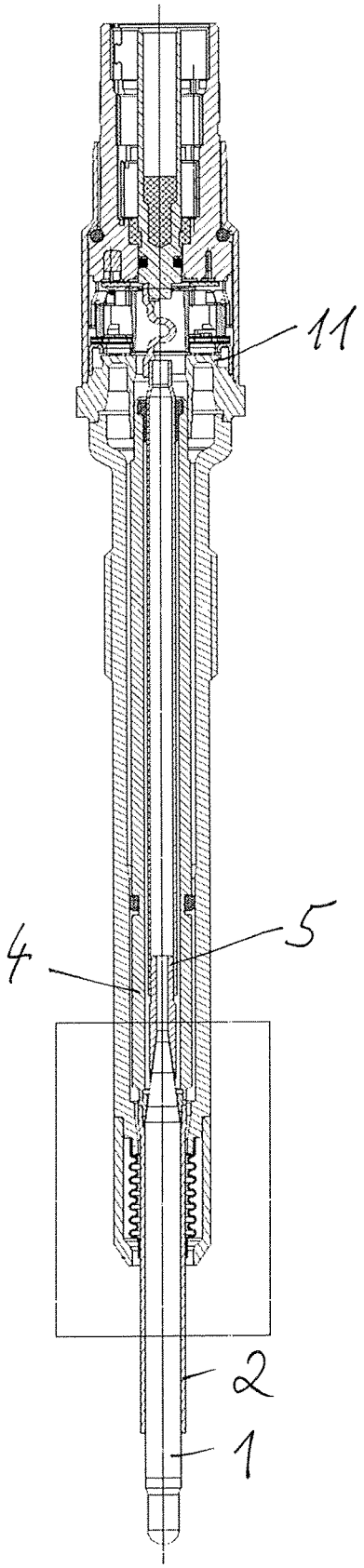
FIG. 1 shows an embodiment of a glow plug according to this disclosure.

FIG. 1 shows in a sectioned view a glow plug with a ceramic glow pin 1, which projects out of a casing, which for example can be composed of casing parts 9, 10. The ceramic glow pin 1 is surrounded by a protective tube 2 made of metal, for example steel. The front combustion chamber side end of the glow plug 1, i.e., the glow tip, projects out of the protective tube 2.

Figure 2:
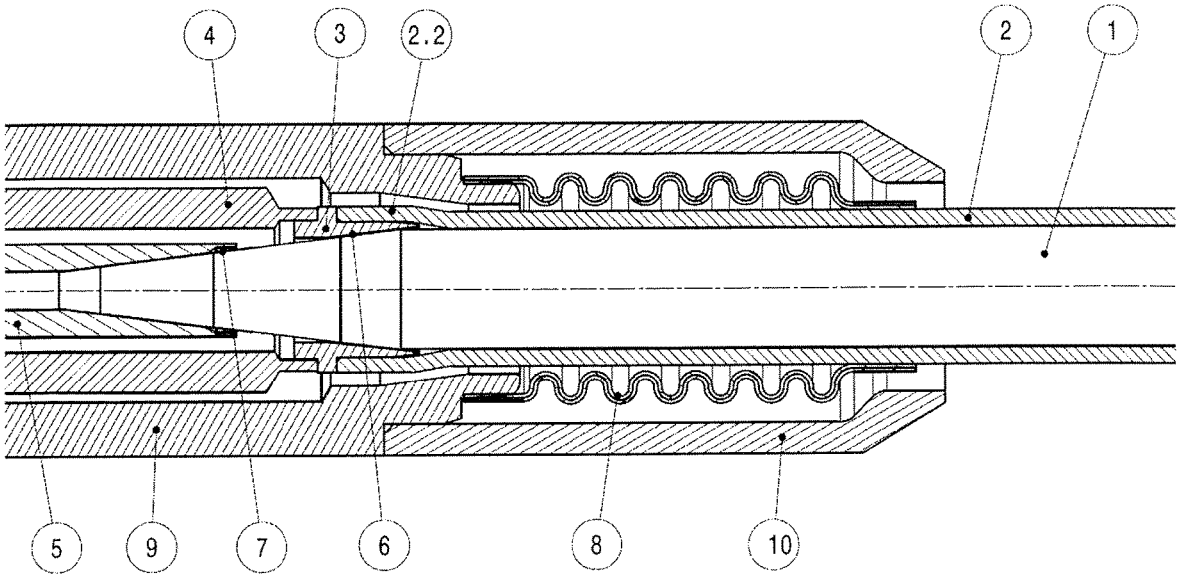
FIG. 2 shows a detail view to FIG. 1.

As is shown in particular by FIG. 2 as detail view, the ceramic glow pin 1 is tapered at its rear end, for example conically tapered and, there, electrically connected to a center electrode 5, for example in that it is inserted into a fitting recess 7 and soldered there. The protective tube 2 has a widened end section 2.2 which surrounds at least one part of the tapered end section of the glow pin 1. The widened end section 2.2 of the protective tube 2 is expanded through plastic deformation, which is sometimes also described as "flaring." The widening, i.e., the increasing of the diameter, is small relative to the width of the protective tube and amounts for example to only between 0.5 and 2 times the wall thickness of the protective tube 2, wherein the wall thickness is based on the undeformed cylindrical main section of the protective tube 2.

The conically tapered end section of the ceramic glow pin 1 is soldered to an annular or sleeve-shaped contact element 3. The ceramic glow pin 1 projects through the contact element 3. In the shown embodiment, the earth contact of the glow pin 1 is affected via the contact element 3 while the potential connection is affected via the central electrode 5.

The contact element 3 has a funnel-shaped for example conical inner surface 6 which matches the tapered shape of the end section of the ceramic glow pin 1. An outer surface of the contact element 3, which is preferentially shaped cylindrically, is connected to the widened end section 2.2. of the protective tube 2, for example, welded.

The embodiment shown in FIG. 1 is a pressure measuring glow plug. The ceramic glow plug 1 is moveable against a resetting force in its longitudinal direction under the effect of the combustion chamber pressure. Combustion chamber pressure is transmitted from the protective tube 2 via the contact element 3 to a transmission element 4 which presses on a pressure sensor 11. The pressure sensor 11 can for example be a piezoelectric sensor or a metal diaphragm with a strain gauge attached thereon.

The widened end section 2.2 practically has the same wall thickness as the remaining part of the protective tube 2 and can therefore favourably transmit pressure signals.

For sealing against combustion chamber gases, a section of the protective tube 2 in the casing is surrounded by a bellows 8, which with an end is fastened to the protective tube 2 and with its other end to the casing.

Figure 3:
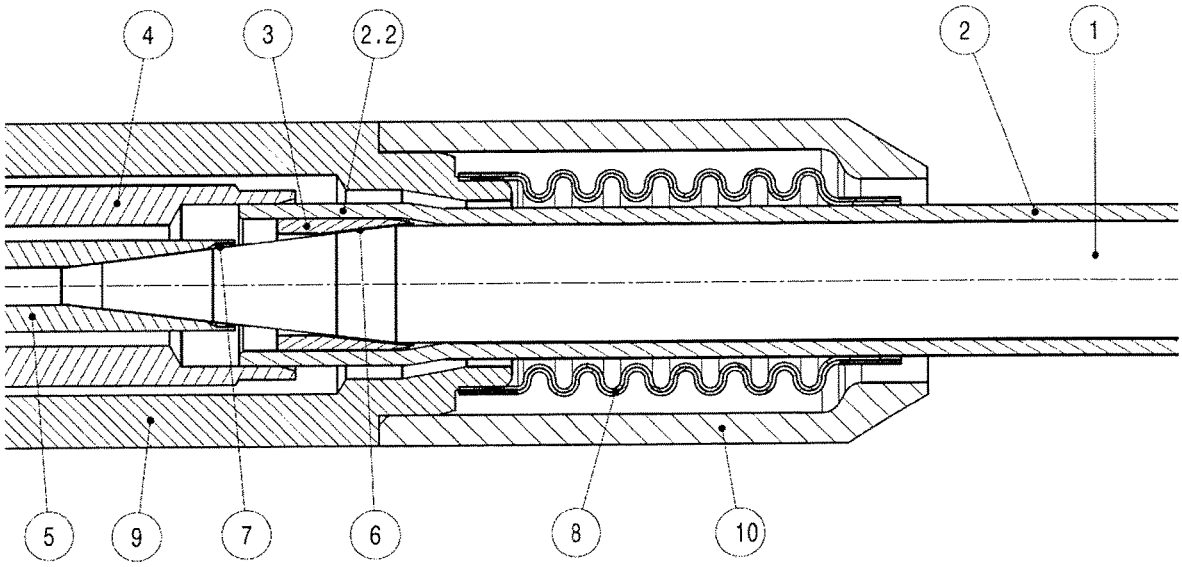
FIG. 3 shows a detail view of a further embodiment of a glow plug according to this disclosure.

FIG. 3 shows a detail view of a further embodiment of a pressure measuring glow plug which differs from the embodiment of FIG. 1 substantially in that the contact element 3 is entirely arranged inside the protective tube 2, namely in the widened end section 2.2 of the same. The protective tube 2 with this embodiment is welded to the transmission element 4, for example via a through-weld. The widened end section 2.2 of the protective tube 2 is inserted into the transmission element 4 and can be directly welded to the same.

In comparison with the embodiment of the FIGS. 1 and 2, the contact element 3 in FIG. 3 is shaped more simply. In addition, by inserting protective tube 2 and transmission element 4 into one another length tolerances can be offset and the position of the weld can be varied in longitudinal direction without consequences regarding the load capacity. By way of this construction, the assembly becomes mechanically more stable, in particular against radial loads, since the welds can be affected radially further outside.

The protective tube 2 in this case can be so long that the conically tapered end section of the ceramic glow pin 1 is entirely arranged in the protective tube 2. However it is also possible that the conically tapered end section of the glow pin 1 projects out of the expanded end section 2.2.

Figure 4:
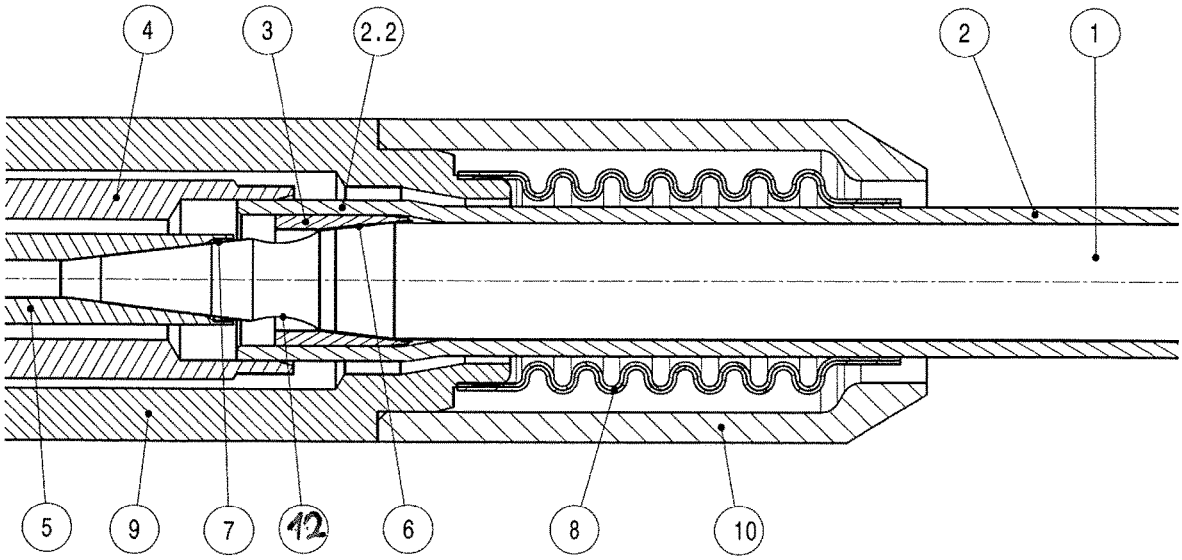
FIG. 4 shows a detail view of a further embodiment of a glow plug according to this disclosure.

FIG. 4 shows a detail view of a further embodiment of a pressure measuring glow plug. It differs from the glow plug according to FIG. 3 substantially in that the ceramic glow pin 1, in the conical region between the contact points to the contact element 3 and to the center electrode 5 has a predetermined breaking point 12, for example in the form of an annular groove 19. Through this intended breaking point the damage location in the event of an impermissibly high mechanical load is placed in this region. In the case of a break or fracture, the heating rod 1 is still held via the contact element 3 and thus cannot fall into the combustion chamber. The predetermined breaking point 12 can for example be also formed as a notch or an interrupted annular groove.

While exemplary embodiments have been disclosed hereinabove, the present invention is not limited to the disclosed embodiments. Instead, this application is intended to cover any variations, uses, or adaptations of this disclosure using its general principles. Further, this application is intended to cover such departures from the present disclosure as come within known or customary practice in the art to which this invention pertains and which fall within the limits of the appended claims.

REFERENCE LIST

1 Glow pin
2 Protective tube
2.2 End section of the protective tube
3 Contact element
4 Transmission element
5 Center electrode
6 Inner surface
7 Recess
8 Bellows
9 Casing part
10 Casing part
11 Pressure sensor
12 Annular groove

What is claimed is:

1. A glow plug, comprising:

a casing;

a ceramic glow pin protruding out of the casing and having a tapered end section inside the casing;

a metal protective tube protruding out of the casing and surrounding the glow pin, the protective tube having a widened end section inside the casing;

a center electrode arranged in the casing and electrically connected to the glow pin; and an annular or sleeve-shaped contact element through which the glow pin projects and to which the tapered end section of the glow pin is soldered, the contact element being at least partly surrounded by the widened end section of the protective tube.

2. The glow plug according to claim 1, wherein the end section of the glow pin is conically tapered and the contact element, which sits between the widened end section of the protective tube and the conically tapered end section of the glow pin, has an inner surface shaped to match the conically tapered end section of the glow pin.

3. The glow plug according to claim 2, wherein the contact element has a cylindrically shaped outer surface.

4. The glow plug according to claim 1, wherein the end section of the protective tube is plastically deformed.

5. The glow plug according to claim 1, wherein the glow pin is moveable along a longitudinal direction relative to the casing, wherein the glow plug further comprises a transmission element configured to press on a pressure sensor upon movement in the longitudinal direction of the protective tube.

6. The glow plug according to claim 5, wherein the protective tube and the transmission element are inserted into one another.

7. The glow plug according to claim 5, wherein the widened end section of the protective tube is substantially cylindrical.

8. The glow plug according to claim 1, wherein the protective tube has a cylindrical main section.

9. The glow plug according to claim 8, wherein the widened end section of the protective tube has a smaller inner diameter than the outer diameter of the cylindrical main section of the protective tube.

10. The glow plug according to claim 1, wherein the contact element is arranged entirely in the protective tube.

11. The glow plug according to claim 1, wherein the tapered end section of the glow pin between the contact element and the center electrode comprises a predetermined breaking point.

12. The glow plug according to claim 11, wherein the predetermined breaking point is a circumferential annular groove.

* * * * *